US005373103A

United States Patent [19]

Orr, Jr. et al.

[11] Patent Number: 5,373,103

[45] Date of Patent: Dec. 13, 1994

[54] RIBBON ELECTRICAL TRANSMISSION CABLE WITH WOVEN SHIELDING

[75] Inventors: Lawrence W. Orr, Jr., Simpsonville; Kathryne R. Hammett, Piedmont, both of S.C.

[73] Assignee: Woven Electronics Corp., Simpsonville, S.C.

[21] Appl. No.: 103,529

[22] Filed: Aug. 9, 1993

[51] Int. Cl.[5] ..... H01B 7/08

[52] U.S. Cl. ..... 174/36; 174/117 M

[58] Field of Search ..... 174/36, 117 M, 117 F, 174/117 R

[56] References Cited

U.S. PATENT DOCUMENTS

| | | | |
|---|---|---|---|
| 1,784,217 | 12/1930 | Berry . | |
| 3,239,916 | 3/1966 | Love | 29/155.5 |
| 3,495,025 | 2/1970 | Ross | 174/117 M |
| 3,654,381 | 4/1972 | Copp | 174/117 |
| 4,095,042 | 6/1978 | Ross | 174/36 |
| 4,234,146 | 11/1980 | Shima et al. | 248/63 |
| 4,281,211 | 7/1981 | Tatum et al. | 174/36 |
| 4,442,314 | 4/1984 | Piper | 174/36 |
| 4,746,769 | 5/1988 | Piper | 174/117 M |
| 4,808,771 | 2/1989 | Orr, Jr. | 174/72 R |
| 4,818,820 | 4/1989 | LaRock | 174/36 |
| 4,910,358 | 3/1990 | Mittelbusher | 174/32 |
| 4,937,400 | 6/1990 | Williams | 174/95 |

*Primary Examiner*—Morris H. Nimmo

*Attorney, Agent, or Firm*—Henry S. Jaudon; Cort Flint

[57] ABSTRACT

A woven shielded cable in which a plurality of conductor wires and a plurality of spacer cords are alternately arranged to extend longitudinally of the cable. A woven outer cover is formed from metalized warp and weft yarns, to encapsulate the conductor and spacer cords to form a shield therefor. A set of binder yarns weave with the weft yarns on opposite side of the conductor wires and spacer cords to positively lock the warp yarns, the spacer cords and the conductor wires in position relative to each other. The cable may be formed with a hinge arranged longitudinally along an intermediate point. In this instance the warp yarns are divided into two groups which weave on opposed sides of the hinge and on opposite surfaces of the opposite sides. The conductor wires are stacked and shielded from each other when the cable is folded along the hinge.

24 Claims, 3 Drawing Sheets

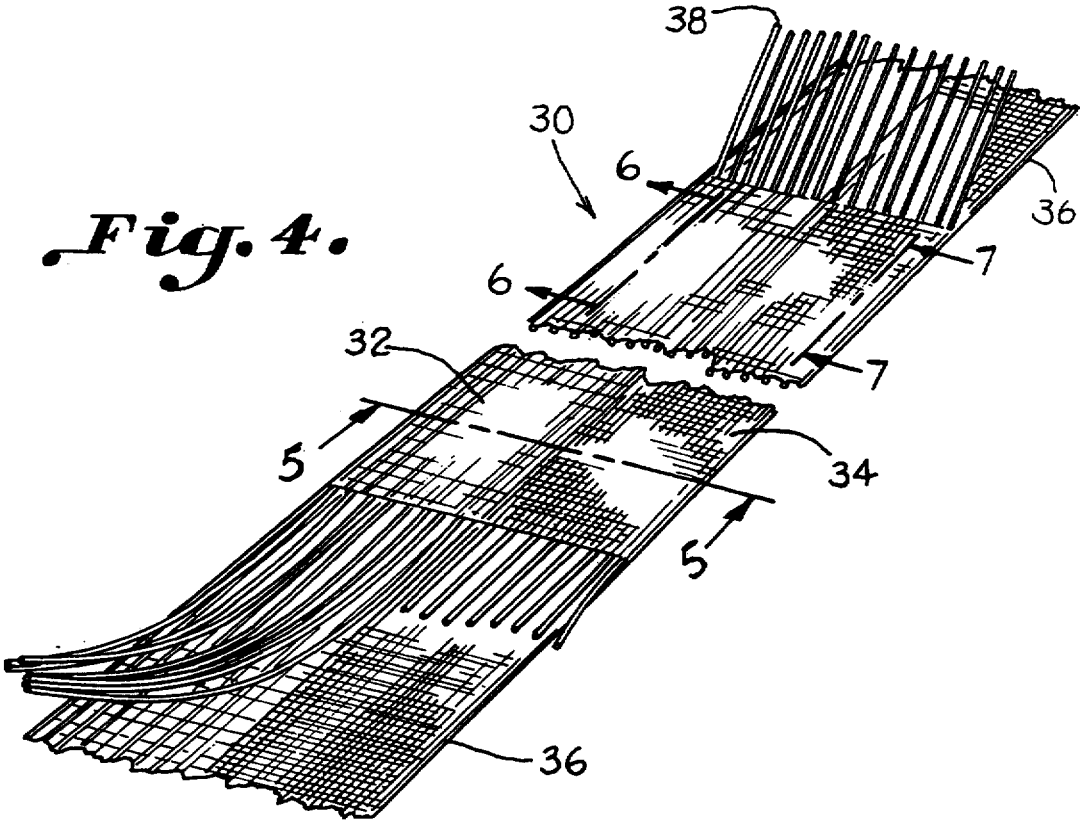
Fig. 4.
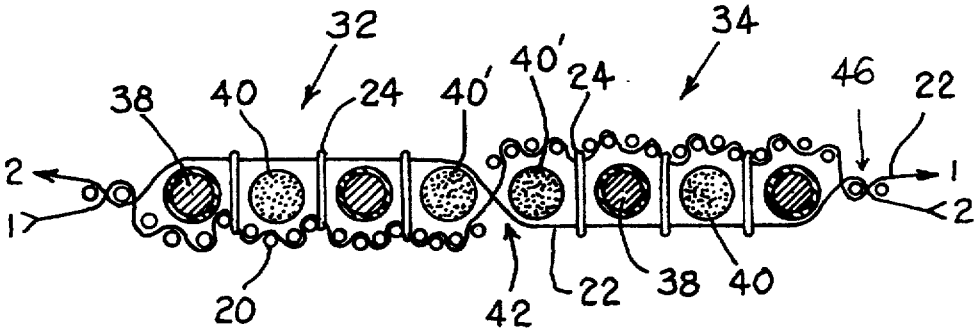
Fig. 5-A.
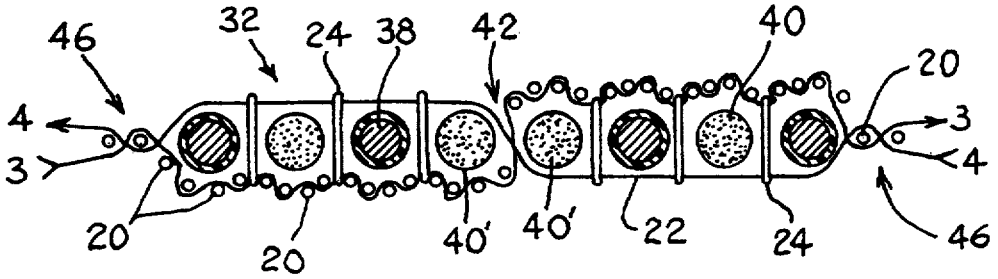
Fig. 5-B.

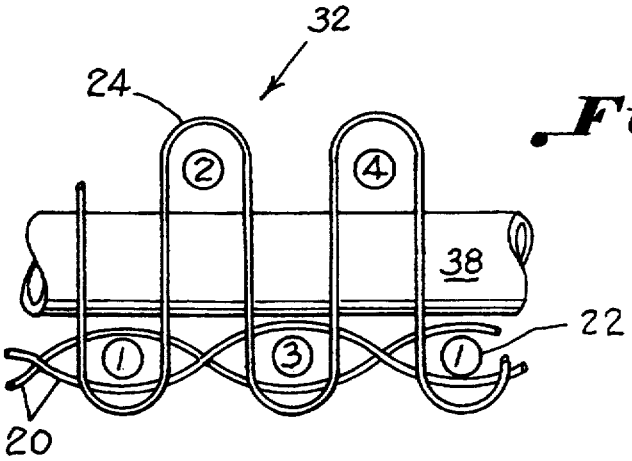
Fig. 6-A.
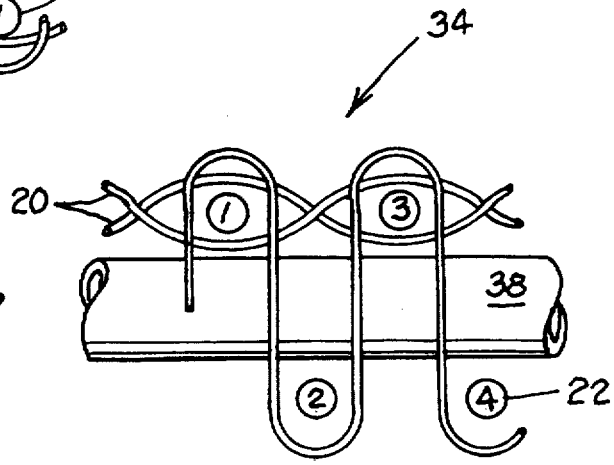
Fig. 6-B.
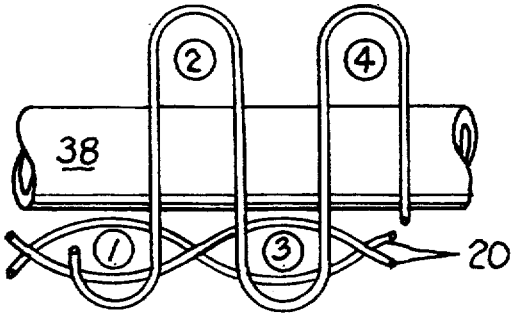
Fig. 7-A.
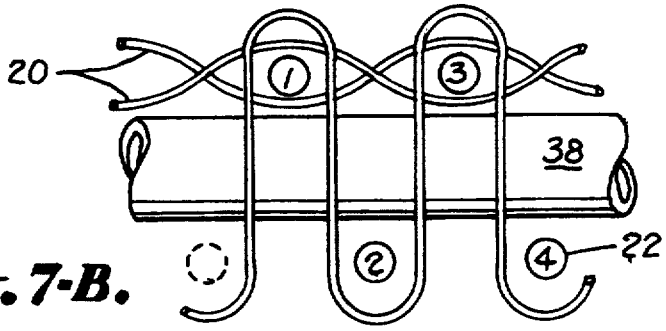
Fig. 7-B.

RIBBON ELECTRICAL TRANSMISSION CABLE WITH WOVEN SHIELDING

BACKGROUND OF THE INVENTION

The invention relates to a ribbon or flat electrical transmission cable of the woven type which has woven shielding woven in preselected portions of the cable.

Heretofore, flat woven electrical transmission cable has been provided which includes a plurality of signal conductors arranged generally in a side by side manner extending longitudinally throughout the woven cable. In many applications it is desirable to provide shielding for the cable to reduce interference with the signals being transmitted over the signal conductors. For example, U.S. Pat. No. 4,281,211 discloses a woven jacket assembly for encasing a woven electrical transmission cable which includes a metallic shield carried within the woven cover for shielding. U.S. Pat. No. 4,442,314 discloses a shielded woven cable assembly and method of making the assembly wherein a plurality of drain wires are interwoven and floated out of a base weave pattern to provide instantaneous and continuous draining of a conductive shield material which encases the woven cable. Again, the woven shield material is an aluminum or other suitable foil wrapped around the cable. U.S. Pat. No. 4,095,042 discloses a woven electrical transmission cable of the ribbon type wherein the conductors are fixed in the woven pattern of the cable, and the cable is woven using metalized or conductive fibers to form an effective shield around and between certain conductors. This provides a highly flexible and effective shielding, however, shielding provided between the conductors is minimal. U.S. Pat. No. 4,818,820 discloses a ribbon electrical transmission cable assembly, with multiple cable layers separated by a conductive shield, and surrounded by an outer wrapped shield and elastomeric cover. However, little, if any, shielding occurs between adjacent conductors. The assembly is also expensive due to the large amounts of material needed to construct and shield the cable. This also makes the assembly heavy for many aerospace applications.

Accordingly an object of the invention is to provide a flat woven electrical transmission cable having a plurality of conductors arranged side by side which are shielded in a more effective and versatile manner.

Another object of the invention is to provide a woven electrical transmission cable having a plurality of signal conductors which are arranged in a spaced relationship across the width of the cable and fixed with conductive warp elements extending between adjacent conductors and woven with said conductors in a woven pattern to fix the relationships.

Another object of the invention is to provide a woven cable having a plurality of signal conductors arranged in a generally side by side arrangement, and between adjacent conductors warp and weft yarns consisting of metalized or conductive fibers are woven in different patterns to provide shielding over selected portions of the cable in generally lightweight embodiment.

Another object of the invention is to provide a wide, flat woven electrical transmission cable having a plurality of conductors arranged generally side by side in a spaced relationship wherein a woven cover shield is woven over reverse sides of the cable at selected portions so that cable may be folded and stacked upon itself with shielding between stacked layers.

Another object of the invention is to provide an electrical transmission cable having woven shielding as its outer cover.

Another object of the invention is to provide a light weight electrical transmission cable which is effectively shielded.

SUMMARY OF THE INVENTION

This invention is directed to a woven shielded electrical cable constructed for use in areas where weight and size are of primary consideration. The woven shielded cable is constructed to have a plurality of conductor wires extending along a single longitudinal plane and with a plurality of longitudinally extending spacer cords arranged between adjacent conductor wires. An outer cover, which is formed from metal containing warp and weft yarns is woven with the warp yarns longitudinally of the cable and to form a shield about the conductor wires. A set of binder yarns are arranged to also extend longitudinally of the cable weave with the weft yarns on opposite sides of the conductor wires and the spacer cords to positively lock the warp strands, the spacer cords and the conductor wires in position relative to each other.

The warp yarns are divided into a first group of warp yarns which weave with the weft yarns in a plane above the plane of the conductor wires and the spacer cords and a second group of warp yarns which weave with the weft yarns in a plane below the plane of the conductor wires and the spacer cords.

Tabs are formed at opposed ends of the cable. The tabs include the first and second group of warp yarns, the spacer cords, the binder warp yarns and the weft yarn. The conductor wires extend exposed longitudinally of and adjacent one side of the tabs. A third group of warp strands are disposed intermediate of the upper and lower planes and adjacent to the outermost conductor wires. These warp yarns also weave with the weft yarns to form the shield completely about the circumference of the conductor cable.

The conductor wires are normally separated from each other by a single spacer cord.

The metal containing warp yarns, weft yarns, binder yarns and spacer cords may be formed of metalized or conductive synthetic, such as, for example, Kevlar, nylon or polyester yarns. The metal is normally silver. The weave is a four pick repeat with an equal number of weft yarns above and below the conductor wires. The binder warp yarns weave with the weft yarns above and below the conductor wires and spacer cords. Also, the warp strands and the weft yarns may form a selvage of selective width along a single plane on opposed edges of the shielded cable.

The woven shielded cable is primarily formed for use with an air craft fuselage. The shielded cable is formed of a first and second group of conductor wires extending longitudinally thereof and spaced by a plurality of spacer cords intermediate thereof. An outer cover or shield is formed on one side of the first group of conductor wires and on the opposite side of the second group of conductor wires. The cover is woven of metalized or conductive yarns which provide a shield for over approximately half of each group of conductor wires but on opposite sides of the cable. The woven outer cover includes binder yarns and weft yarns which weave above and below both the first and second groups of conductor wires to stabilize the conductor wires within the cable. Also, a selvage is formed along opposite outer edges of the cables and tabs are formed at opposite ends of the shielded cable. The tabs extend along a longitudinally plane spaced from the longitudinal plane of the conductor wires. The tabs are woven from the warp yarns, the spacer cords, the weft yarns and the binder yarns. The shield, which includes the spacer cords, acts to drain interference away from the conductor wires.

The weave forms a hinge which is arranged longitudinally of the cable. The hinge separates the first group of conductor wires from the second group of conductor wires. The hinge allows the shielded cable to be folded along its length to position the conductor wires in a stacked relationship which provides a shield which completely encases one of the first and second groups of conductor wires. The end product is a cable of reduced width and weight.

The warp yarns, weft yarns, binder yarns and spacer cords are formed of metalized nylon, Kevlar or polyester yarns. The most desirable metal is silver and it may be applied by coating, or by intermingling metal filaments or fibers with the yard and cords. The weave is a four pick repeat with an equal number of weft yarns, warp yarns and binder yarns weaving above and below each group of conductor wires and spacer cords.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is a perspective view embodying an alternative arrangement of a woven flat shielded electrical cable according to the invention;

FIG. 5A is a sectional end view of the shielded cable of FIG. 4 taken generally along line 5—5 showing pick 1 and pick 2;

FIG. 5B is a sectional end view of the shielded cable of FIG. 4 taken generally along line 5—5 showing pick 3 and pick 4;

FIG. 6 is a sectional side view of the shielded cable of FIG. 4 taken along line 6—6 showing the warp weaving below the conductor wires; and, FIG. 7 is a sectional side view of the shielded cable of FIG. 4 taken along line 7—7 showing the warp weaving above the conductor wires.

DESCRIPTION OF A PREFERRED EMBODIMENT

Figure 1:
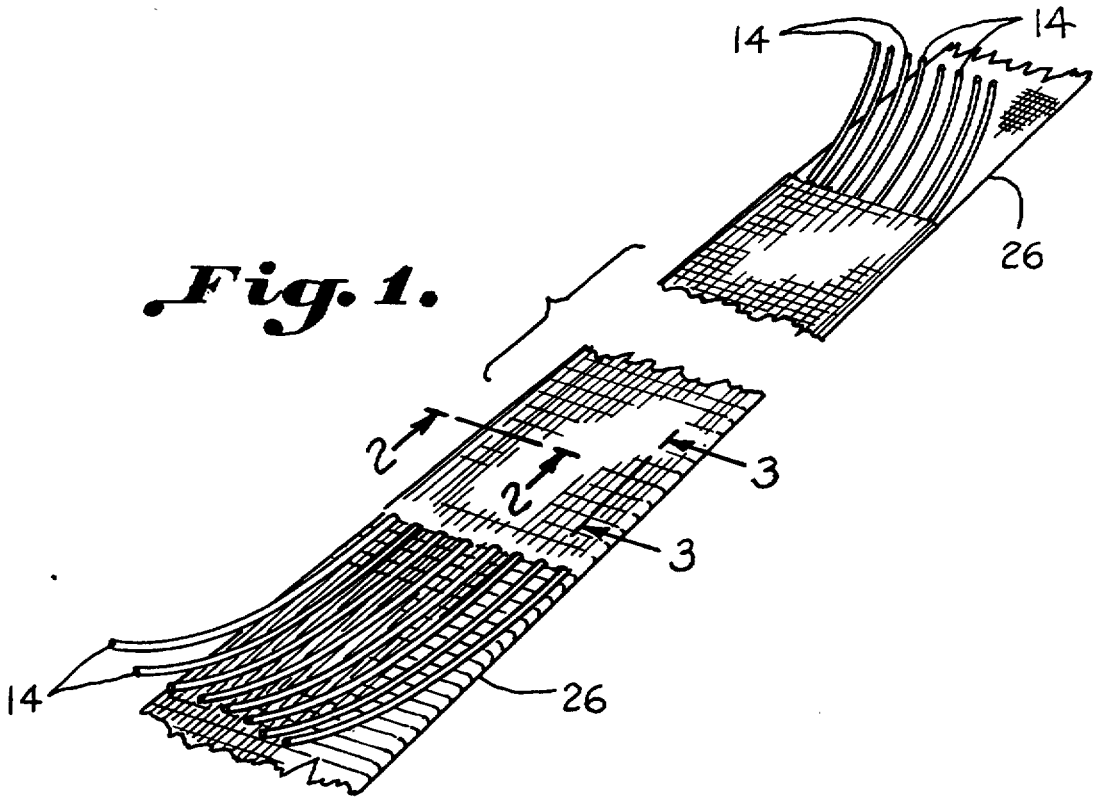
FIG. 1 is a perspective view of a woven flat shielded electrical transmission cable according to the invention.
Figure 2:
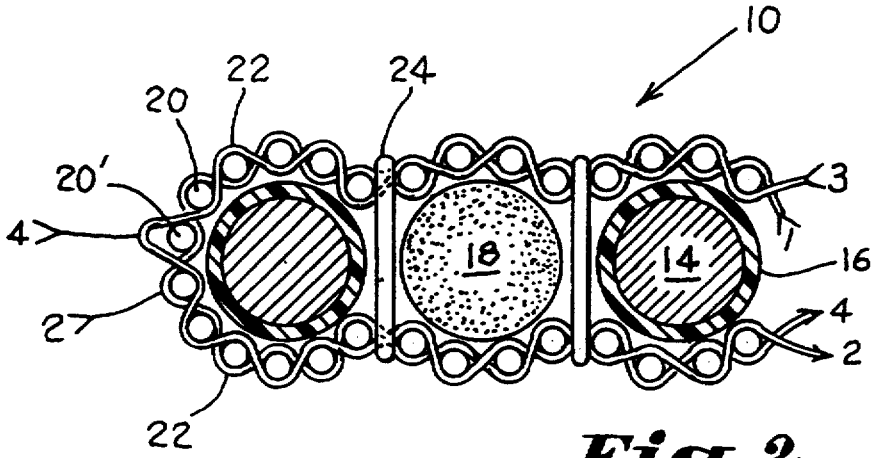
FIG. 2 is a sectional end view of the shielded cable of FIG. 1 taken along line 2—2.
Figure 3:
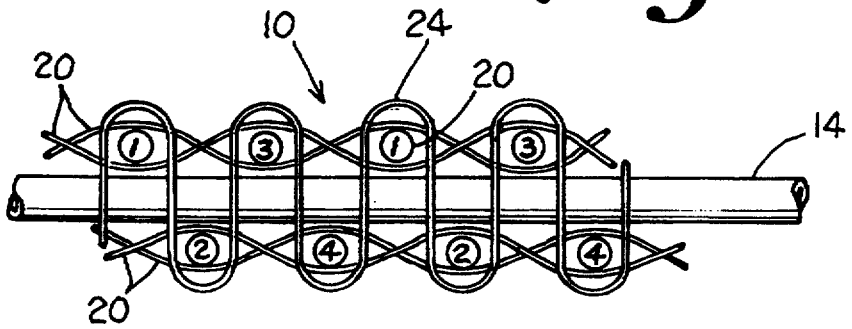
FIG. 3 is a sectional side view of the shielded cable of FIG. 1 taken along lines 3—3.

FIGS. 1-3 of the drawings illustrate a first embodiment of a shielded woven electrical transmission cable designated generally at 10 having a plurality of elongated conductor signal wires 14 for transmitting electrical signals. The cable is woven to have a substantially flat configuration which makes it highly flexible for ease of installation and routing to the proper electrical terminals. The shielded cable of the invention is intended primarily for use in aircraft fuselages where size and weight are of prime consideration.

Shielded cable 10 consists of a plurality of longitudinally extending conductor wires 14 which are enveloped with a usual insulating cover 16. The core of conductor wires 14 may be a single wire or it may consist of a cell of individual wires. Arranged intermediate and adjacent to conductor wires 14 are spacer cords 18 which are preferably of a size substantially equal that of the conductor wire. Spacer cords 18 are preferably metalized, conductive yarns such as nylon or polyester filaments. As illustrated in FIG. 2, spacer cords 18 uniformly separate and isolate each of conductor wires 14 in the internal area of the shielded cable. The outermost filaments of the cable are preferably conductor wires 14 as shown in FIG. 2. The number of conductor wires 14 and spacer cords 18 forming shielded cable 10 is dependent upon the end use and width requirements of the shielded cable and range from a minimum of two, as shown to as many as necessary to provide a cable having the required width and appropriate number of conductor wires. The number of conductor wires 14 and spacer cords 18 necessary to fill a specific width obviously varies depending upon their diameter; i.e. fewer larger diameter cords and wires are required to form a cable of a given width than are smaller diameter cords and wires.

A cover which is woven of metalized warp yarns 20 and metalized weft yarns 22 is formed to extend around conductor wires 14 and spacer cords 18. The warp yarns 20 are arranged in four groups. A first group is arranged to extend above and longitudinally of conductor wires 14 and spacer cords 18, a second group is arranged to extend below and longitudinally of conductor wires 14 and spacer cords 18; and, a third and fourth group are arranged along opposed outer edges of the shielded cable 10 to extend between the planes in which the first and second groups are arranged. The fourth group of warp yarns 20 is not shown.

Weft yarns 22 weave back and forth in a four pick pattern repeat to interlace with warp yarns 20 above and below conductor wires 14 and spacer cords 18.

As seen in FIGS. 2 and 3, the weft yarn 22 passes first from the right side of cable 10 as pick 1. Pick 1 weaves over and under upper warp yarns 20 and passes from the right of cable 10 toward the left exiting warp 20 at approximately warp yarn 20'. Pick 1 passes over conductor wires 14 and spacer cords 18. Pick 2 then passes from the left side of cable 10 entering the warp again approximately at warp yarn 20' to weave over and under warp 20 beneath conductor wires 14 and spacer cords 18. Pick 3 passes again from the right over the conductor wires and spacer cords weaving on the opposite sides of warp 20 as clearly shown. Pick 4, passing from the left, completes the weave pattern by weaving with warp yarns 20 beneath the conductor wires 14 and spacer cords 18. It is noted that picks 3 and 4 move over the sides of warp 20 opposite the side over which picks 1 and 2 move. FIG. 2 shows the conductor wire 14 and spacer cord 18, by omission as extending along a single longitudinal plane.

Binder yarns 24 are arranged across the width of shielded cable 10 and extend parallel with spacer cords 18, conductor wires 14 and warp yarns 20. A binder yarn 24 is preferably arranged between each adjacent conductor wire 14 and spacer cord 18. Binder yarns 24 weave over upper level weft yarns 22 and below lower level weft yarns 22 and act to secure the woven cover about the conductor wires 14 and spacer cords 18 to secure them in position within the woven cable 10. The spacer cords 18 act to positively and uniformly isolate conductor wires 14 from each other while also assisting in draining away any interference.

A tab 26 is formed at opposite ends of shielded cable 10. The tabs are woven along a common plane and are formed by weft yarn 22 interlacing with warp yarns 20, binder yarns 24, and spacer cords 18. Conductor wires 14 are brought out of the weave pattern and extend in a common plane above or below tabs 26. The tabs may be employed to secure the shielded cable 10 in position and act to ground the woven shield to remove interference. The exposed conductor wires are connected with appropriate terminal members.

Warp yarns 20, weft yarns 22 and binder yarns 24 are metalized by having a metal coating applied thereto or by having metal filaments or fibers interspersed therewith. Any known process for incorporating the metal with these yarns is acceptable. Warp yarns 20, weft yarns 22 and binder yarns 24 are each preferably formed from one of nylon, Kevlar or polyester.

An alternative embodiment of a shielded transmission cable 30 is shown in FIGS. 4–7. Shielded cable 30 consist of a body portion having a first half 32 and a second half 34 which are bound at opposite ends by tabs 36. First and second halves 32 and 34 are formed with a first plurality conductor wires 38 arranged as a single plane longitudinally of shielded cable 30 and separated by spacer cords 40 which also extend along the same plane. At the approximate mid point of shielded cable 30 a hinge 42 is formed to extend longitudinally of the cable. Hinge 42 is formed of a pair of side by side arranged spacer cords 40′ between which each pick of weft yarn 22 passes as it moves between upper and lower surfaces of shielded cable 30.

Warp yarns 20 are arranged below conductor wires 38 and spacer cords 40 of first half 32 and above conductor wires 38 and spacer cords 40 of second half 34. Weft yarns 22 are woven with the warp yarns in a four pick repeat pattern similar to that earlier described. As shown in FIGS. 5A, 5B, 6 and 7, the first pick 1 of weft yarn 22 passes from left to right and interlaces with warp yarns 20 below conductor wires 38 and spacer cords 40 of first half 32, it then passes between adjacent spacer cords 40′ to weave with the remainder of warp yarns 20 above conductor wires 38 and spacer cords 40 of second half 34. Pick 2 of weft yarn 22 returns from the right side of the cable 30 to extend across second half 34 below spacer cords 40 and conductor wires 38. Pick 2 passes up between spacer cords 40′ to extend across first half 32 and over conductor wires 38 and spacer cords 40.

Pick 3 again moves from the left to weave with warp yarns 20 below first half 32, and pass between spacer cords 40′ to weave with warp yarns 20 over second half 34. Pick 4 completes the pattern, coming from the right to pass under conductor wires 38 and spacer cords 40 of the second half 34. Pick 4 then passes between spacer yarns 40′ and over conductor wires 38 and spacer cords 40 of first half 32.

Arranged between adjacent conductor wires 38 and spacer cords 40 are binder yarns 24 which pass over each of the weft yarns arranged over conductor wires 38 and spacer cords 40 and also under each of the weft yarns arranged below spacer cords 40 and conductor wires 38, as clearly shown in FIGS. 6 and 7. Binder yarns 24 act to securely fix the relative positions of conductor wires 38 and spacer cords 40. Binder yarns 24 also act to draw weft yarns 22 and warp yarns 20 together in position about conductor wires 38 and spacer cords 40 and to further secure them in position relative to each other and to the warp and weft. Binder yarns 24 may be formed of the same materials as warp and weft yarns 20 and 22.

As shown in FIGS. 5A and 5B, certain warp yarns 20 are arranged adjacent the outer most of the conductor wires 38. The number of warp yarns arranged here varies from two, as shown, to as many as required to form a selvage of the desired width. The weft yarn 22 of picks 1,2, 3 and 4 weaves with these outer most warp yarns forming selvages 46 at each side of shielded cable 30. The selvages 46 may be used to assist in positioning shielded cable 30. The selvages serve as ground means and may have metal grommets placed therein.

Tabs 36 are formed at each end of shielded cable 30 by weaving weft yarns 22 with warp yarns 20, binder yarns 24 and spacer cords 40 along a single plane while the conductor wires 38 are brought out of the weave pattern to extend along one side of that plane. The conductor wires are exposed so they may be connected with suitable terminal members while tabs 36 provide means to assist in securing the shielded cable in position and also as ground means as discussed relative to shielded cable 10.

It is noted that the weft yarn 22 which extends across the exposed surface of side 32 passes beneath binder yarns 24, above conductor wires 38 and spacer cords 40 while the weft yarn which extends across exposed surfaces of side 34 passes above binder yarns 24 and below conductor wires 38 and spacer cords 40. This interrelationship between binder yarns 24 and weft yarns 22 maintain the weft yarns in position in the exposed areas and also acts to secure the conductor wires 38 in position relative to the spacer cords 40 and the warp yarns 20.

There are an equal number of weft yarns 22 arranged on each surface of shielded cable 30 across its width and along its length.

In use, shielded cable 30 is folded along its length at hinge 42 so that the woven cover of side 34 is folded over onto the exposed surface of side 32. This configuration provides that in use shielded cable 30 comprises stacked conductor wires in which all of conductor wires 38 of side 32 are completely encapsulated with a woven shield and are separated from conductor wires 38 of side 34. It is not necessary that conductor wires 38 of side 34 be shielded on both sides in all instances. This second side may be shielded if necessary by a portion of the housing in which shielded cable 30 is fitted.

The warp yarns 20, weft yarns 22, binder yarns 24 and spacer cords 40 of shielded cable 30 are conductive and are formed of the same materials as are those yarns and cords in shielded cable 10. Also, in shielded cable 30, spacer cords 40 act to fixedly position conductor wires 38 relative to each other, and with the woven fabric shield. Spacer cords 40 also act to assist in draining away interference from conductor wires 40.

While a preferred embodiment of the invention has been described using specific terms, such description is for illustrative purposes only, and it is to be understood that changes and variations may be made without departing from the spirit or scope of the following claims.

What is claimed is:

1. A woven shielded cable comprising:

a plurality of conductor wires extending longitudinally of said cable;

a plurality of spacer cords extending longitudinally of said cable;

a woven outer cover formed from metal containing warp and weft yarns, said warp yarns extending longitudinally of said cable, said weft yarns extending transversely of said cable and weaving over and under said warp yarns, said conductor wires and said spacer cords to shield said conductor wires;

a set of binder yarns extending longitudinally of said cable, said binder yarns weaving with said weft yarns on opposite sides of said conductor wires and said spacer cords to positively lock said warp yarns, said spacer cords and said conductor wires in position relative to each other.

2. The cable of claim 1 wherein a first group of said warp yarns weave with said weft yarns in an upper plane above the plane of said conductor wires and said spacer cords and a second group of said warp yarns weave with said weft yarns in a lower plane below the plane of said conductor wires and spacer cords.

3. The cable of claim 2 wherein tabs are formed at opposed ends of said cable, said tabs include said first and second group of warp yarns, said spacer cords, said binder yarns and said weft yarn.

4. The cable of claim 3 wherein said conductor wires extend exposed longitudinally of and adjacent one side of said tabs.

5. The cable of claim 2 wherein said warp yarns include a third group, said third group of warp yarns being disposed intermediate said upper and lower planes adjacent outermost conductor wires to interweave with said weft yarns and form said shield to encapsulate said conductor wires and said spacer cords of said cable.

6. The cable of claim 2 wherein there are at least two of said warp yarns of said first and second groups of warp yarns weaving with said weft yarns above and below each of said conductor wires.

7. The cable of claim 1 wherein said conductor wires and spacer cords extend along a single longitudinal plane.

8. The cable of claim 1 wherein said conductor wires are separated from each other along their length by a single said spacer cord.

9. The cable of claim 1 wherein said conductor wires are arranged in transversely spaced first and second groups of conductor wires, said first group of conductor wires being separated from said second group of conductor wires by a hinge extending longitudinally of said shielded cable; whereby, said shielded cable may be folded along its length about said hinge to form said cable to half its width with multilayers of conductor wires completely shielded from each other.

10. The cable of claim 9 wherein said hinge is formed by juxtaposed spacer cords.

11. The cable of claim 9 wherein said warp yarns extend on one side of said first group of conductor wires along the length of said cable and on the opposite side of said second group of conductor wires along the length of said cable.

12. The cable of claim 9 wherein said weft yarns weave over and under said conductor wires, said spacer cords and said warp yarns.

13. The shield of claim 12 wherein said weave is a four pick repeat.

14. The cable of claim 12 wherein said binder warp yarns weave with said weft yarns above and below said conductor wires and spacer cords to firmly locate each relative the other.

15. The shield of claim 12 wherein there are an equal number of weft yarns weaving above and below said conductor wires and said spacer cords.

16. The shield of claim 1 wherein said metal containing warp yarns and weft yarns are one of Kevlar, nylon and polyester.

17. The shield of claim 16 wherein said metal is silver.

18. The shield of claim 1 wherein said spacer cords are conductive and act to drain interference away from said conductive wires.

19. The cable of claim 1 wherein said warp yarns and said weft yarns form a selvage of selective width along a single plane on opposed edges of said shielded cable.

20. A woven shielded cable formed for use with an air craft fuselage wherein size and weight are prime considerations, said shielded cable comprising;

a first and second group of conductor wires extending longitudinally of said cable;

a plurality of spacer cords extending longitudinally of said cable and arranged to separate said conductor wires;

a woven outer cover formed of metalized yarns arranged on one side of said first group of conductor wires and on an opposite side of said second group of conductor wires providing a shield for approximately half each said one and opposite sides of said cable;

a hinge arranged longitudinally of said cable, said hinge separating said first group of conductor wires from said second group of conductor wires; whereby, said shielded cable may be folded along said hinge to position said conductor wires in stacked relationship and to provide a shield which completely encases one of said first and second groups of conductor wires and to produce a cable of reduced width and weight.

21. The cable of claim 20 wherein said metalized yarns forming said woven outer cover include warp yarns, binder yarns and weft yarns which weave above and below both said first and second groups of conductor wires and spacer cords to stabilize said conductor wires and spacer cords within said cable.

22. The cable of claim 20 wherein said cover includes a selvage formed along opposite outer edges of said cable.

23. The cable of claim 20 wherein tabs are formed continuous with said woven cover at opposite ends of said cable, said tabs extend along a longitudinal plane spaced from the longitudinal plane of said conductor wires.

24. The cable of claim 23 wherein said spacer cords are conductive and act to drain interference away from said conductor wires.

* * * * *